US006184523B1

(12) United States Patent
Dowben et al.

(10) Patent No.: US 6,184,523 B1
(45) **Date of Patent: *Feb. 6, 2001**

(54) HIGH RESOLUTION CHARGED PARTICLE-ENERGY DETECTING, MULTIPLE SEQUENTIAL STAGE, COMPACT, SMALL DIAMETER, RETRACTABLE CYLINDRICAL MIRROR ANALYZER SYSTEM, AND METHOD OF USE

(75) Inventors: Peter A. Dowben, Crete, NE (US); Carlo Waldfried, Arlington, VA (US); Tara J. McAvoy, Santa Barbara, CA (US); David N. McIlroy, Moscow, ID (US)

(73) Assignee: Board of Regents of the University of Nebraska, Lincoln, NE (US)

( * ) Notice: Under 35 U.S.C. 154(b), the term of this patent shall be extended for 0 days.

This patent is subject to a terminal disclaimer.

(21) Appl. No.: 09/114,999

(22) Filed: Jul. 14, 1998

(51) Int. Cl.[7] ..... H01J 49/48
(52) U.S. Cl. ..... 250/305
(58) Field of Search ..... 250/305, 396 R

(56) References Cited

U.S. PATENT DOCUMENTS

| | | | |
|---|---|---|---|
| 3,761,707 | 9/1973 | Liebl | 250/41.9 |
| 3,783,280 | 1/1974 | Watson | 250/305 |
| 3,949,221 | 4/1976 | Liebl | 250/281 |
| 4,048,498 | 9/1977 | Gerlach et al. | 250/305 |
| 4,205,226 | 5/1980 | Gerlach | 250/305 |
| 4,218,617 | 8/1980 | Cazaux | 250/305 |
| 4,593,196 | 6/1986 | Yates | 250/305 |
| 4,769,542 | 9/1988 | Rocket | 250/305 |
| 4,849,641 | 7/1989 | Berhowitz | 250/492.2 |
| 4,860,224 | 8/1989 | Cashell et al. | 364/551.01 |
| 5,032,723 | 7/1991 | Kono | 250/305 |
| 5,099,117 | 3/1992 | Frohn et al. | 250/306 |
| 5,541,410 | 7/1996 | Dowben et al. | 250/305 |
| 6,104,029 * | 8/2000 | Coxon et al. | 250/305 |

* cited by examiner

*Primary Examiner*—Kiet T. Nguyen
(74) *Attorney, Agent, or Firm*—James D. Welch

(57) ABSTRACT

Disclosed is a compact, small diameter, high resolution charged particle-energy detecting, retractable cylindrical mirror analyzer system. Multiple sequential stages enable charged particle-energy detection with an improved resolution as compared to that possible where only a single stage is utilized. The relatively small size allows for positioning, via a manipulator of the cylindrical mirror analyzer system, which is attached to a linear motion feedthrough mounted on a conflat flange of a vacuum system.

38 Claims, 5 Drawing Sheets

HIGH RESOLUTION CHARGED PARTICLE-ENERGY DETECTING, MULTIPLE SEQUENTIAL STAGE, COMPACT, SMALL DIAMETER, RETRACTABLE CYLINDRICAL MIRROR ANALYZER SYSTEM, AND METHOD OF USE

TECHNICAL FIELD

The present invention relates to charged particle-energy detecting cylindrical mirror analyzers generally, and more particularly to an easily positionable, compact, small diameter, high resolution charged particle-energy detecting, multiple sequential stage, retractable cylindrical mirror analyzer system which, in use, enables charged particles, which have energies within specified bands, to be detected with an improved resolution, as compared to that possible where only a single stage is utilized.

BACKGROUND

The use of cylindrical mirror analyzers to enable detection of charged particles of a specific energy, (i.e. particle-energy), is well known. Generally, cylindrical mirror analyzers allow charged particles with energies within a certain range of energies, (but not charged particles with energies outside said certain range of energies), which enter thereinto at an angle within an acceptance range of angles, to exit therefrom and be directed into a detector. The presence of a charged particle which transverses a cylindrical mirror analyzer at a detector is a "count-like" indication that said charged particle had an energy within a certain range of energies and entered said cylindrical mirror analyzer at an angle thereto within an acceptance range of angles. In use, parameters of operation, (e.g. applied voltage as discussed supra herein), can be user adjusted and thus allow selection of:

"energy—charged-particle—angle of entry"

combinations that can pass through a relatively fixed geometry cylindrical mirror analyzer system, and be subsequently detected.

To aide with understanding of the present invention it must be understood that cylindrical mirror analyzers generally comprise two finite length, elongated, concentric essentially tubular shaped elements, (i.e. outer and central-most), which two finite length elongated concentric essentially tubular shaped elements are typically of a functional, essentially equal, length. Each of said two elongated concentric essentially tubular shaped elements is preferably, but not necessarily, essentially circular shaped in cross-section, and the central-most concentric essentially tubular shaped element has holes through the tubular wall thereof near each longitudinally opposed end thereof, such that in use, charged particles can enter and exit the formed annular space between said outer and central-most elongated concentric essentially tubular shaped elements through holes at first and second ends, respectively, of said central-most concentric essentially tubular shaped element.

In use, a voltage is applied between the outer and central-most concentric essentially tubular shaped elements such that an electric field is effected in said formed annular space therebetween, and such that charged particles which enter into said annular space at some energy related velocity and trajectory locus angle, via said a hole through the first end of the tubular wall of said central-most elongated concentric essentially tubular shaped element, are guided in their further trajectory locus through, and out of, said annular space. Entering charged particles with an energy, (i.e. velocity), within a range which is determined by the applied voltage across the two elongated concentric essentially tubular shaped elements, (and the roughly the distance from said first hole, to a second hole through the central-most essentially tubular shaped element wall), will be guided so as to exit said annular space between said outer and central-most essentially tubular shaped elements, through a second hole through the wall of said central-most elongated concentric essentially tubular shaped element, at the opposed longitudinal, (e.g. second), end of the central-most elongated concentric essentially tubular shaped element. A detector for detecting charged particles is typically positioned to intercept said exiting charged particles. Charged particles which do not enter the annular space, or which enter at other than an angle within a range of acceptance angles, or which have an energy outside the "detection" range, (which again is determined by the applied voltage and distance between said first and second holes through the wall of the central-most elongated concentric essentially tubular shaped element), will not be guided in their trajectory locus so as to exit the annular space through said hole through the wall of said at the opposed, second, longitudinal end of the central-most elongated concentric essentially tubular shaped element. Instead such charged particles with energies outside the "detection" range etc. will typically collide with, for instance, the inner surface of the essentially tubular shaped wall of the outer elongated concentric essentially tubular shaped element, or the outer surface of the essentially tubular shaped wall of the central-most elongated concentric essentially tubular shaped element. Assuming a charged particle has an entry trajectory locus angle within a range of acceptance angles, it can then be appreciated that only particles which have an energy, (i.e. mass, charge and velocity), within a "detection" range, and which enter the identified annular space, can be expected to reach the indicated detector through a cylindrical mirror analyzer. It should also be appreciated that the "detection" range of energies of charged particle which are guided into the detector for detecting charged particles of a given charge, is easily user determined by adjustment of the voltage applied between the two, (outer and central-most), concentric essentially tubular shaped elements and the electric field formed in said annular space as a result. Within limits, this is the case regardless of fixed physical distance between the first and second holes in the wall of the central-most elongated concentric essentially tubular shaped element, as voltage applied between the two, (outer and central-most), concentric essentially tubular shaped elements is continuously adjustable over a practical range. It is also noted that charged particles have associated therewith mass, and because the trajectory of a charged particle moving in an electric field is effected by said charged particle mass, cylindrical mirror analyzers can, alternatively, be employed as a mass-spectrometer, similar to a time of flight mass-spectrometer, where the magnitude of the charge present is known.

Representative, non-limiting sources of energetic charged particles which can be analyzed by cylindrical mirror analyzers include Auger, electron photoemission, and low energy positive ion scattering systems. That is, particles with either positive or negative charge can be detected. A particularly relevant source of charged particles is a material sample system which is caused to be bombarded by a source of energetic excitation, such as a beam of electrons, photons or ions. As a result of interaction between said bombarding particles, or photons, and said material sample system, charged particles are emitted from said material sample system.

Until recently, typical known cylindrical mirror analyzers were large and bulky and required fixed placement, or placement on a bulky position manipulator. This was the case as to attain high resolution charged particle-energy detecting, large diameter elongated concentric essentially tubular shaped elements, (i.e. outer and central-most), were thought to be necessary. A 1996 Patent to Dowben et al., U.S. Pat. No. 5,541,410, however, described a single pass cylindrical mirror analyzer of a relatively reduced diameter and size, which reduced size single pass cylindrical mirror analyzer, could be easily mounted on a flange mounted linear motion feedthrough, such that insertion and retraction of said reduced size single pass cylindrical mirror analyzer, to and from a position at which charged particles to be detected were present, the energies of which charged particles are to be investigated, could be easily achieved utilizing, for instance, a bellows-type linear motion feedthrough means. This ease of adjustment, it is noted, provided a major advantage and improvement over then existing cylindrical mirror analyzer systems. Continuing, typical outer and central-most concentric essentially tubular shaped elements in the system described in the 410 Patent are, for the outer concentric essentially tubular shaped element, in the range of thirty (30) to fifty (50) millimeters, and for the central-most concentric essentially tubular shaped element, in the range of fifteen (15) to forty (40) millimeters. The length of the 410 Patent cylindrical mirror analyzer system was disclosed as being approximately forty-five (45) millimeters. It is also noted that the 410 Patent system is dimensioned so as to accept charged particles which enter thereto along a trajectory locus oriented at an optimum acceptance angle of forty-two (42) degrees-eighteen-and-one-half (18.5) minutes with respect to the longitudinal locus of the single pass cylindrical mirror analyzer. It is further noted that said 410 Patent single pass cylindrical mirror analyzer further comprises a cylindrical housing having first and second ends positioned to generally coincide with first and second ends of the outer and central-most finite length elongated concentric essentially tubular shaped elements, said cylindrical housing being concentrically positioned outside and around said outer essentially tubular shaped concentric element. The cylindrical housing further comprises, at the first end thereof, a typically conical cap which presents with an aperture located therein for allowing charged particles to enter. At the second end of said 410 Patent single pass cylindrical mirror analyzer, there is present a manipulator for use in manipulation of the retractable single stage cylindrical mirror analyzer system into a position wherein charged particles can enter thereto. Said manipulator can be affixed to a bellows-type linear motion feedthrough in use, and the entire assembly can be mounted on a vacuum flange having a diameter in the range of seventy (70) to two-hundred (200) millimeters, inclusive, including a conflat type flange.

While the benefits of the 410 Patent reduced size single stage, single pass cylindrical mirror analyzer are significant, (with focus being on the ease of mounting and positioning thereof in a vacuum system), it has been found that greater charged particle-energy detection resolution than can typically be achieved by its use, would be very desirable. The present invention teaches that greater charged particle-energy detection resolution is achieved by a compact, small diameter, high charged particle-energy detection resolution, "multiple sequential stage", retractable cylindrical mirror analyzer system which, in use, enables charged particle-energy detection with an improved resolution over that possible where single stage, compact, small diameter, retractable cylindrical mirror analyzers are utilized.

Additional, less relevant, known Patents which were cited in the 410 Patent are U.S. Pat. Nos. 4,048,498 and 4,205,226 to Gerlach et al. and Gerlach respectively, and U.S. Pat. No. 5,099,117 to Frohn et al.

Another, less relevant, Patent of which the inventor is aware is U.S. Pat. No. 3,783,280 to Watson. In the Watson 280 Patent, FIG. 5 is specifically identified as it shows a typical cylindrical mirror double pass configuration wherein a pair of inner (62) and outer (63) coaxial cylindrical tubular electrodes are present. It is noted that multiple holes (61), (65), (68) and (69) through which charged particles can pass are present in the continuous inner cylindrical tubular electrode. It is further noted that a charged particle passing through the entire FIG. 5 configuration follows a locus which is roughly a full sinusoid-like cycle and that the same electric field is encountered by such a charged particle in the annular space between inner (62) and outer (63) coaxial cylindrical tubular electrodes for said charged particle entering thereinto through hole (61) or hole (68). That is, there is nothing in Watson 280 to indicate that the inner electrode (62) is not electrically continuous over its entire length.

U.S. Pat. Nos. 3,935,453 and 3,949,221 to Liebl describe the presence of multiple electrodes in a cylindrical mirror system, but said multiple electrodes are configured in a single pass arrangement.

Other patents which describe cylindrical mirror systems, of which the Inventor is aware, are:

U.S. Pat. No. 4,769,542 to Rockett;

U.S. Pat. No. 4,218,617 to Cazaux;

U.S. Pat. No. 3,761,707 to Liebl;

U.S. Pat. No. 4,593,196 to Yates;

U.S. Pat. No. 4,860,224 to Cashell et al.;

U.S. Pat. No. 5,032,723 to Kono; and

U.S. Pat. No. 4,849,641 to Berkowitz.

Scientific articles of which the inventor is aware which describe particle energy analyzing cylindrical mirrors and/or analysis or use thereof are:

1. "A Novel Design For A Small Retractable Cylindrical Mirror Analyzer", McIlroy, Dowben & Ruhl, J. Vac. Sci. Technol. B, 13(5) Sep/Oct 1995. This reference describes a single pass system, in which the inner cylinder electrode is held at ground potential.
2. "Angle-Resolving Photoelectron Energy Analyzer: Mode Calculations, Ray-Tracing, Analysis and Performance Evaluation", Stevens et al., J. of Electron Spectroscopy and Related Phenomena 32 (1983).
3. "Analysis Of The Energy Distribution In Cylindrical Electron Spectrometers", Aksela, The Review of Scientific Instruments, Vol. 42, No. 6, (1971).
4. "An Electrostatic Mirror Spectrometer With Coaxial Electrodes For Multi-Detector Operation", Wannberg, Nuclear Instruments and Methods, 107 (1973).
5. "Cylindrical Capacitor As An Analyzer* I. Nonrelativistic Part", Sar-El, The Review of Scientific Instruments, Vol. 38, No. 9, (1967).
6. "Internal Scattering In A Single Pass Cylindrical Mirror Analysis", Bakush et al., J. of Electron Spectroscopy and Related Phenomena 74, (1995).
7. "On The Image Properties Of An Electro-Static Cylindrical Electron Spectrometer", Karras et al., Annals Academiae Scientiarum Fennicae, (1968).
8. Criterion For Comparing Analyzers", Sar-El, The Review of Scientific Instruments, Vol. 41, No. 4, (1969).
9. "Adsorbtion And Bonding Of Molecular Icosahedra On Cu(100)", Zeng et al., Surface Science, 313 (1994).

It is also noted that the present Application is commonly owned with the 410 Patent, (which is incorporated herein by reference). It is in that light that some claims in the present Disclosure are focused on single stage, (i.e. single-pass), compact, small diameter, retractable cylindrical mirror analyzers without the limitation of a grounded inner cylindrical electrode.

DISCLOSURE OF THE INVENTION

The preferred embodiment of the present invention is a compact, small diameter, high resolution charged particle-energy detecting, multiple (two) sequential stage, retractable cylindrical mirror analyzer system. In use, the present invention allows charged particle-energy detection with an improved resolution compared to that possible where only a single stage cylindrical mirror analyzer is present.

Each of said present invention multiple sequential stages is a cylindrical mirror analyzer comprising:

a. a concentric outer essentially tubular shaped element having a tubular wall with an inner surface, and first and second ends;

b. a concentric central-most essentially tubular shaped element having a tubular wall with an outer surface and first and second ends, with holes through said tubular wall being present near both said first and second ends thereof, said central-most essentially tubular shaped element being present within said concentric outer essentially tubular shaped element such that an annular space is formed between the inner surface of the tubular wall of said outer essentially tubular shaped element and the outer surface of said tubular wall of said central most essentially tubular shaped element;

c. means for applying electrical potential to each of said concentric outer and central-most essentially tubular shaped elements to the end that an electric field is formed in said annular space between said concentric outer and central-most essentially tubular shaped elements.

A second end of a first sequential cylindrical mirror analyzer is secured to a first end of a second sequential cylindrical mirror analyzer. In use a charged particle caused to enter said annular space between said concentric outer and central-most essentially tubular shaped elements via a hole through the tubular wall at a first end of said central-most essentially tubular shaped element of said first sequential cylindrical mirror analyzer, has its trajectory locus determined by an electric field caused to be present therein by application of a first voltage between said means for applying electrical potential to each of said concentric outer and central-most essentially tubular shaped elements, and exits from said first sequential cylindrical mirror analyzer annular space via a hole through said central-most essentially tubular shaped element at the second end of said center-most essentially tubular shaped element in said first sequential cylindrical mirror analyzer. Said charged particle then enters an annular space between said concentric outer and central-most essentially tubular shaped elements via a hole through the tubular wall at a first end of said central-most essentially tubular shaped element of said second sequential cylindrical mirror analyzer, has its trajectory locus determined by an electric field caused to be present therein by application of a second voltage between said means for applying electrical potential to each of said concentric outer and central-most essentially tubular shaped elements, and exits from said second sequential cylindrical mirror analyzer annular space via a hole through said central-most essentially tubular shaped element at the second end of said second sequential cylindrical mirror analyzer.

It is to be understood that a charged particle caused to enter said first sequential cylindrical mirror analyzer, exits said second sequential cylindrical mirror analyzer only if said charged particle has an energy within a user determined detection range of energies and approached said first sequential cylindrical mirror analyzer at an angle within a range of acceptance angles so as to pass through said hole through the tubular wall at said first end of said central-most essentially tubular shaped element of said first sequential cylindrical mirror analyzer. Said energy detection range is at least partially determined by said electrical potential applied to each of said concentric outer and central-most essentially tubular shaped elements in each said first and second sequential cylindrical mirror analyzers.

The present invention compact, small diameter, high resolution particle-energy detecting, multiple sequential stage, retractable cylindrical mirror analyzer system can further comprise at least a third stage, wherein the second end of said second sequential cylindrical mirror analyzer is secured to a first end of said third sequential cylindrical mirror analyzer to form the system. Likewise forth, fifth etc. stages can be added, but normally are not utilized as the improved resolution benefits provided by more than two stages has not been determined to be beneficial.

In use, the present invention compact, small diameter, high resolution particle-energy detecting, multiple sequential stage, retractable cylindrical mirror analyzer system has a first voltage applied between said means for applying electrical potential to each of said concentric outer and central-most essentially tubular shaped elements of said first sequential cylindrical mirror analyzer is selected from the group consisting of: (the same as and different than), as compared to a second voltage applied between said means for applying electrical potential to each of said concentric outer and central-most essentially tubular shaped elements of said second sequential cylindrical mirror analyzer. The electric field in the annular space of said first sequential cylindrical mirror analyzer is caused to be a selection from the group consisting of: (the same as, greater than and less than), as compared to the electric field in the annular space of the second sequential cylindrical mirror analyzer. While a typical application will provide that the electric fields in annular spaces in successive stages will be equal, it has been found the use of different electric fields in successive stages allows greater charged particle detection resolution.

Each stage of a present invention compact, small diameter, high resolution charged particle-energy detecting, multiple sequential stage, retractable cylindrical mirror analyzer system further comprises a cylindrical housing having first and second ends. A cylindrical housing corresponding to a stage is concentrically positioned outside and around said outer essentially tubular shaped concentric element. At least the cylindrical housing of the first sequential stage of said multiple sequential stages further comprises, at a first end thereof, a cap, (typically conical in shape and hereinafter referred to as a cap), which presents with an aperture (e.g. a slit), located essentially centrally therein for allowing entry of charged particles. Each present cylindrical housing, (and present cap), is/are preferably made of magnetic field blocking mu-metal, and it is noted that a where a cylindrical housing and cap are both present, said elements can be of a continuous single piece construction, or can be two joined elements.

An important feature of the present invention compact, small diameter, high resolution charged particle-energy detecting, multiple sequential stage, retractable cylindrical mirror analyzer system is that the second end of the last sequential stage of said multiple sequential stages further comprises a manipulator for manipulation of the compact, small diameter, high resolution energy detecting, multiple sequential stage, retractable cylindrical mirror analyzer system into a position wherein charged particles can enter to said first sequential stage thereof. In particular said manipulator can be imparted motion by a bellows driven linear motion feedthrough.

To provide some insight into representative dimensions of a present invention compact, small diameter, high resolution charged particle-energy detecting, multiple sequential stage, retractable cylindrical mirror analyzer system each stage outer essentially tubular shaped concentric element(s) typically have inner diameters of between 30 and 50 millimeters inclusive, and all present outer essentially tubular shaped concentric element(s) typically, but not necessarily, have the same inner diameter. As well, all present central-most essentially tubular shaped concentric element(s) typically have outer diameters of between 15 and 40 millimeters inclusive, and all present center-most essentially tubular shaped concentric element(s) typically, but not necessarily, have the same outer diameter. Actual operating present invention systems to date have been constructed with a per stage length on the order of forty-five millimeters. It is further noted that each stage of a present invention compact, small diameter, high resolution charged particle-energy detecting, sequential multiple stage, retractable cylindrical mirror analyzer system typically has a focal length of from 5 to 10 millimeters, with a nominal value of 6 millimeters, in front of the first central-most cylinder entrance aperture.

As alluded to, the present invention compact, small diameter, high resolution charged particle-energy detecting, multiple sequential stage, retractable cylindrical mirror analyzer system manipulator at the second end of the last sequential stage of said multiple sequential stages is a linear motion feedthrough, is optionally affixed to, and driven by, a bellows-type motion source. It has been found that all elements of the present invention so constructed can be easily mounted on a vacuum flange having a diameter in the range of seventy (70) to two-hundred (200) millimeters, (i.e. two-and-three-quarters (2.75) and eight (8) inches), and that the vacuum flange can be of a conflat type.

A single stage present invention retractable cylindrical mirror analyzer which, in use, enables charged particle-energy detection comprises:

a. a concentric outer essentially tubular shaped element having a tubular wall with an inner surface, and first and second ends;

b. a concentric central-most essentially tubular shaped element having a tubular wall with an outer surface and first and second ends, with holes through said tubular wall being present near both said first and second ends thereof, said central-most essentially tubular shaped element being present within said concentric outer essentially tubular shaped element such that an annular space is formed between the inner surface of the tubular wall of said outer essentially tubular shaped element and the outer surface of the tubular wall of said central most essentially tubular shaped element;

c. means for applying electrical potential to each of said concentric outer and central-most essentially tubular shaped elements to the end that an electric field is formed in said annular space between said concentric outer and central-most essentially tubular shaped elements. It is specifically pointed-out that said means for applying electrical potential to each of said concentric outer and central-most essentially tubular shaped element is not limited to effecting a ground potential at the central-most essentially tubular shaped element, as was the case in the Dowben 410 Patent System and as was described in the article titled "A Novel Design For A Small Retractable Cylindrical Mirror Analyzer" by McIlroy, Dowben & Ruhl, which appeared in the J. Vac.Sci. Technol. B, 13(5) Sep/Oct 1995, as cited in the Background Section of this Disclosure.

As described for the multiple stage case, in use a charged particle caused to enter said annular space between said concentric outer and central-most essentially tubular shaped elements via a hole through the tubular wall at a first end of said central-most essentially tubular shaped element of said cylindrical mirror analyzer, has its trajectory locus determined by an electric field caused to be present therein by application of a voltage between said means for applying electrical potential to each of said concentric outer and central-most essentially tubular shaped elements, and exits from said first sequential cylindrical mirror analyzer annular space via a hole through said central-most essentially tubular shaped element at the second end of said center-most essentially tubular shaped element in said retractable cylindrical mirror analyzer. A charged particle caused to enter said retractable cylindrical mirror analyzer, exits said retractable cylindrical mirror analyzer only if the charged particle has an energy within a user determined detection range of energies and approached said retractable cylindrical mirror analyzer at an angle within a range of acceptance angles so as to pass through said hole through the tubular wall at said first end of said central-most essentially tubular shaped element of said retractable cylindrical mirror analyzer, said energy detection range being at least partially determined by said electrical potential applied to each of said concentric outer and central-most essentially tubular shaped elements in said retractable cylindrical mirror analyzer. Again, the improvement of the present invention single stage retractable cylindrical mirror analyzer is found in the presence of a manipulator at said second end of said retractable cylindrical mirror analyzer for use in manipulation of the retractable cylindrical mirror analyzer system into a position wherein charged particles can enter to said first end thereof. It is noted that the mounting to the second end of said retractable cylindrical mirror analyzer need not be co-linear with the manipulator, and that manipulator mounting in various directions is both possible and necessary in some applications. As for the multiple stage case, the single stage retractable cylindrical mirror analyzer further comprises a cylindrical housing having first and second ends, said cylindrical housing being concentrically positioned outside and around said outer essentially tubular shaped concentric element, and at a first end thereof is present a cap which presents with an aperture located therein for allowing entry of charged particles thereinto during use. It is noted that preferred practice provides that the manipulator present at the second end of said single stage present invention retractable cylindrical mirror analyzer be affixed to said to said cylindrical housing. As well, the cap and cylindrical housing are selected from the group consisting of: (single piece continuous and interconnected separate elements).

In all embodiments the present cylindrical housing, and optionally said cap, is/are preferably made of magnetic field blocking mu-metal.

Representative dimensions for a single stage present invention retractable cylindrical mirror analyzer are the same as recited infra herein for each stage of a multiple sequential stage present invention compact, small diameter, high resolution particle-energy detecting, retractable cylindrical mirror analyzer system. As well, discussion infra herein related to manipulator-linear feed through-bellows-type motion means, vacuum flange mounting and focal lengths for present invention compact, small diameter, high resolution particle-energy detecting, multiple sequential stage, retractable cylindrical mirror analyzer systems generally apply to a single stage present invention retractable cylindrical mirror analyzer systems in which manipulator at the second end thereof is a linear motion feedthrough.

A method of detecting charged particles comprises the steps of:

a. providing a single stage retractable cylindrical mirror analyzer as described infra herein:

b. by manipulation of said manipulator causing said first end of said retractable cylindrical mirror analyzer to be positioned near charged particles, the energy of which is to be detected;

c. causing electric fields to exist in the annular space of each present cylindrical mirror analyzer stage;

such that charged particles enter said retractable cylindrical mirror analyzer progress therethrough and exit therefrom, thereby being available for entry into a detector.

Said method can involve imparting motion to said manipulator by a linear motion feedthrough which is optionally driven by a bellows-type motion source.

A method of detecting the charged particles which provides improved detection resolution of charged particle-energy, comprises the steps of:

a. providing a compact, small diameter, high charged particle energy detection resolution, multiple sequential stage, retractable cylindrical mirror analyzer system as described infra herein;

b. by manipulation of said manipulator, causing said first end of said first sequential stage cylindrical mirror analyzer to be positioned near charged particles, the energy of which is to be detected;

c. causing electric fields to exist in the annular space of each present cylindrical mirror analyzer stage;

such that charged particles enter said first stage cylindrical mirror analyzer of the compact, small diameter, high energy detection resolution, multiple sequential stage, retractable cylindrical mirror analyzer system, progress through all stages thereof and exit the last stage thereof, thereby being available for entry into a detector.

Said method of detecting the energy of charged particles can involve causing similar or different electric fields to exist in the annular spaces of different stages of the compact, small diameter, high energy detection resolution, multiple sequential stage, retractable cylindrical mirror analyzer system. As alluded to infra herein, it has been found that utilizing different electric fields in different stages can improve charged particle-energy detection resolution.

Said method can also involve causing said first end of said first sequential stage cylindrical mirror analyzer to be positioned near charged particles, by imparting motion to said manipulator by a linear motion feedthrough which is optionally driven by a bellows-type motion source.

The present invention will be better understood by reference to the Detailed Description Section of this Disclosure, in conjunction with the appended drawings.

SUMMARY OF THE INVENTION

It is therefore a primary purpose of the present invention to teach a compact, small diameter, high energy detection resolution, sequential multiple stage, retractable cylindrical mirror analyzer system.

DETAILED DESCRIPTION

Figure 1A:
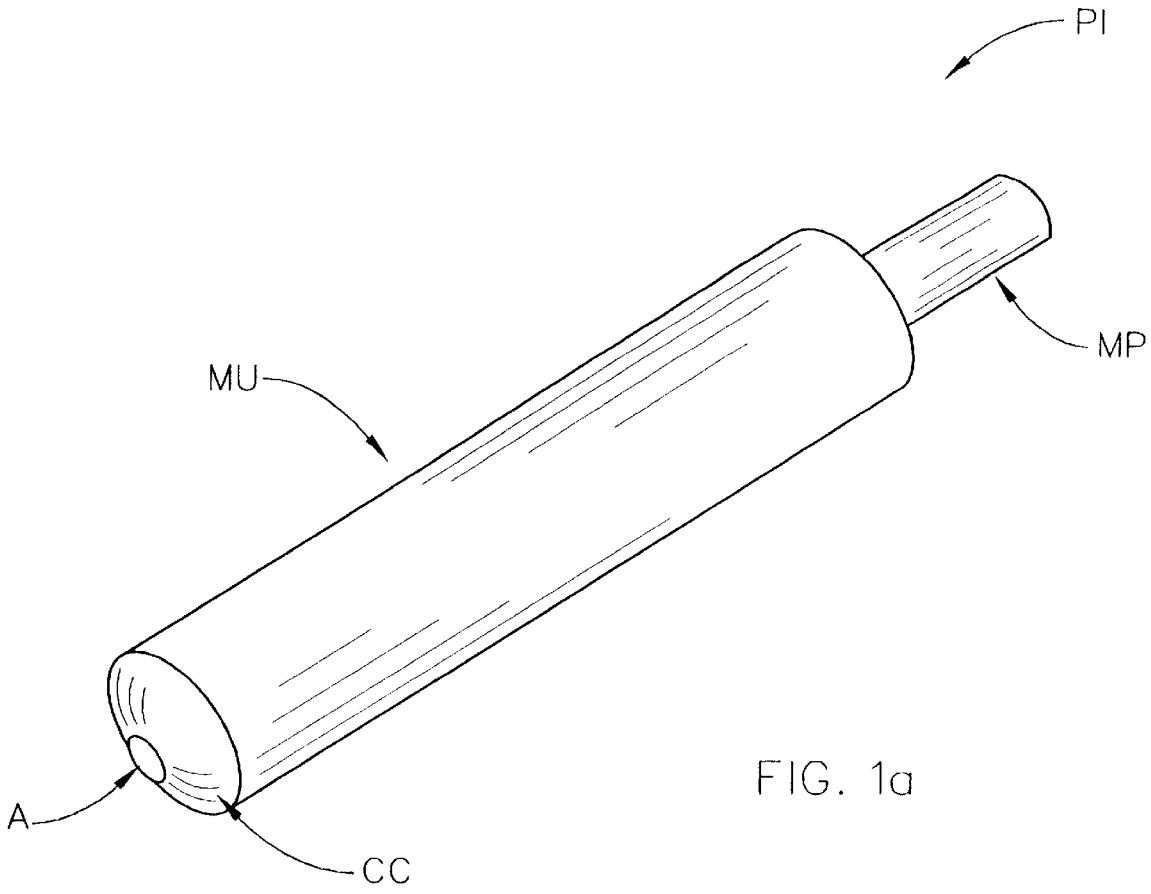
FIG. 1*a* shows an external perspective view of the present invention compact, small diameter, high charged particle-energy detection resolution, single or multiple sequential stage, retractable cylindrical mirror analyzer system.
Figure 1B:
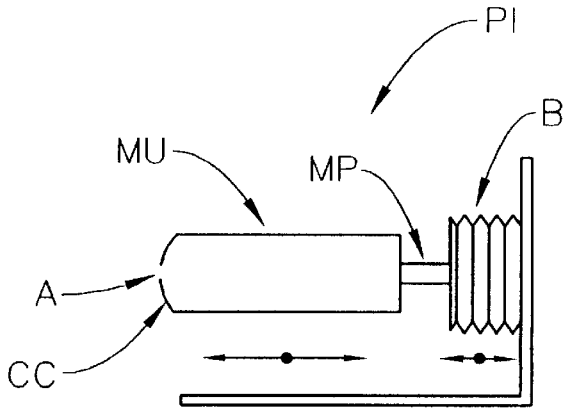
FIG. 1*b* shows a side elevations view of a present invention (PI) compact, small diameter, high charged particle-energy detection resolution, single stage or multiple sequential stage, retractable cylindrical mirror analyzer system affixed to a bellows driven linear motion feedthrough.

Turning now to the Drawings, there is shown in FIG. 1*a* an outer perspective view of a present invention (PI) compact, small diameter, high charged particle-energy detection resolution, single stage or multiple sequential stage, retractable cylindrical mirror analyzer system. Shown is a manipulator means (MP), an Outer Mu-Metal (MU) shield cylindrical housing, which serves to block magnetic field effects, and a cap (CC), which is also preferably made of magnetic field blocking Mu-Metal. An aperture (A) is shown as present in said cap (CC), through which charged particles can enter in use. For convenience, FIG. 1*b* shows a side elevations view of a present invention (PI) compact, small diameter, high charged particle energy detection resolution, single stage or multiple sequential stage, retractable cylindrical mirror analyzer system affixed to a bellows driven linear motion feedthrough.

Figure 2:
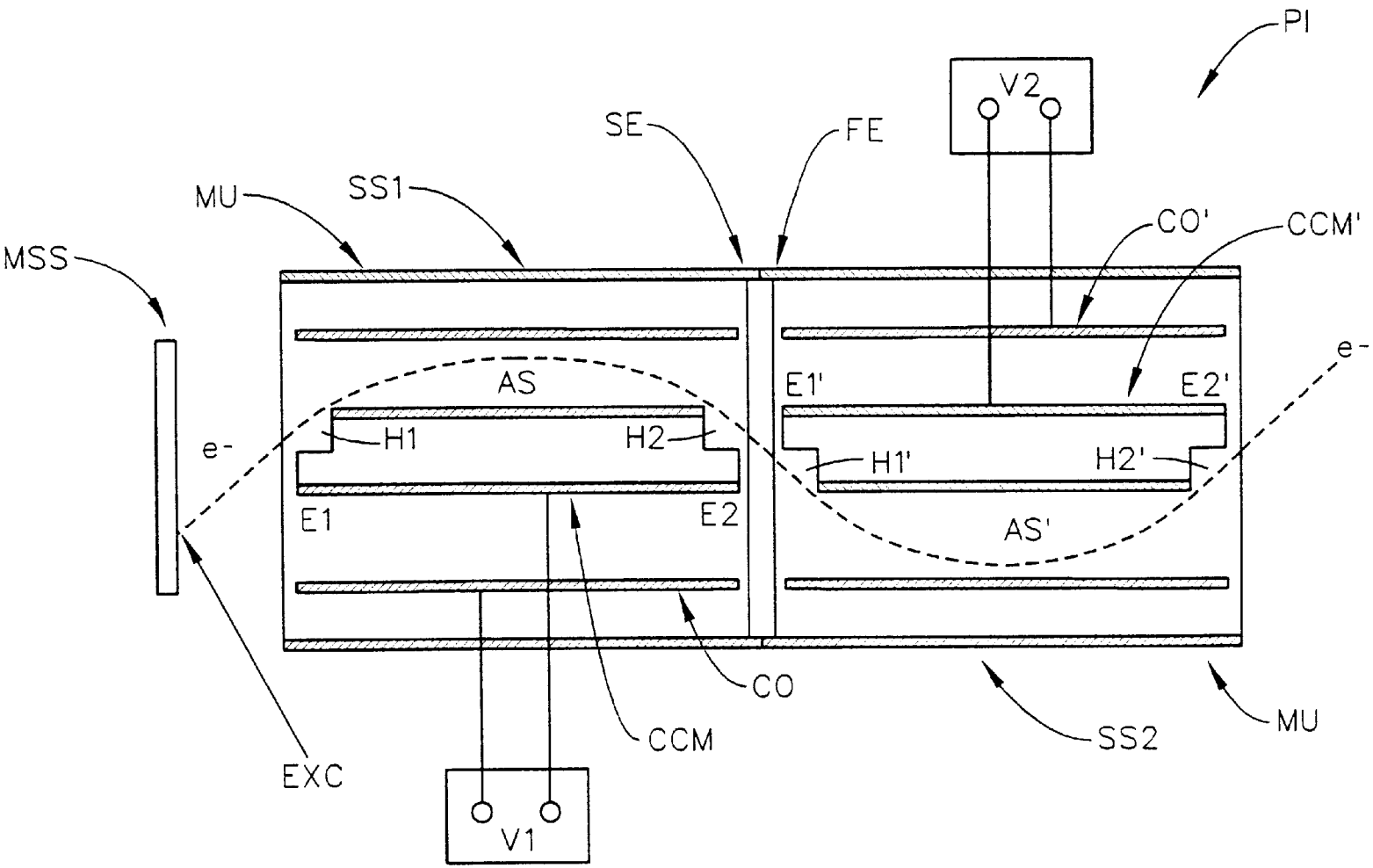
FIG. 2 shows a functional, cut-away view of internal components of a preferred present invention compact, small diameter, high charged particle-energy detection resolution, multiple sequential stage, retractable cylindrical mirror analyzer system comprising two stages.

Turning now to FIG. 2, there is shown a two stage (SS1) (SS2) present invention compact, small diameter, high charged particle-energy detection resolution, multiple sequential stage, retractable cylindrical mirror analyzer system (PI), with the functionality thereof demonstrated.

Each of said present invention multiple sequential stages (SS1) (SS2) is a cylindrical mirror analyzer comprising:

a. a concentric outer essentially tubular shaped element (CO) having a tubular wall with an inner surface, and first (E1) and second (E2) ends;

b. a concentric central-most essentially tubular shaped element (CCM) having a tubular wall and first (E1) and second (E2) ends, with holes through said tubular wall being present near both said first (H1) and second (H2) ends thereof, said central-most essentially tubular shaped element (CCM) being present within said concentric outer essentially tubular shaped element (CO) such that an annular space (AS) is formed between the inner surface of the tubular wall of said outer essentially tubular shaped element and the outer surface of the tubular wall of said central most essentially tubular shaped element;

c. means for applying electrical potential (V1) (V2) to each of said concentric outer (CO) and central-most (CCM) essentially tubular shaped elements to the end that an electric field is formed in said annular space (AS) between said concentric outer (CO) and central-most (CMM) essentially tubular shaped elements.

A second end (SE) of a first sequential cylindrical mirror analyzer is secured to a first end (FE) of a second sequential cylindrical mirror analyzer. In use a charged particle ($e^-$) is caused to enter said annular space (AS) between said concentric outer (CO) and central-most (CCM) essentially tubular shaped elements via a hole (H1) through the tubular wall at a first end of said central-most essentially tubular shaped element (CMM) of said first sequential cylindrical mirror analyzer, has its trajectory locus determined by an electric field caused to be present therein by application of a first voltage (V1) between said means for applying electrical potential to each of said concentric outer (CO) and central-most (CMM) essentially tubular shaped elements, and exits from said first sequential cylindrical mirror analyzer annular space via a hole (H2) through said central-most essentially tubular shaped element (CMM) at the second end (SE) of said center-most essentially tubular shaped element (CMM) in said first sequential cylindrical mirror analyzer. Said charged particle then enters an annular space (AS') between said concentric outer (CO') and central-most (CMM') essentially tubular shaped elements via a hole (H1') through the tubular wall at a first end (E1') of said central-most essentially tubular shaped element (CMM) of said second sequential cylindrical mirror analyzer (SS2), has its trajectory locus determined by an electric field caused to be present therein by application of a second voltage (V2) between said means for applying electrical potential to each of said concentric outer (CO') and central-most (CMM') essentially tubular shaped elements, and exits from said second sequential cylindrical mirror analyzer (SS2) annular space via a hole (H2') through said central-most essentially tubular shaped element (CCM') at the second end (E2') of said second sequential cylindrical mirror analyzer (SS2). If the holes (H1) (H2) (H1') and (H2') were not present the charged particle ($e^-$) would be blocked from entering the Annular Spaces (AS) (AS'). As indicated, a charged particle ($e^-$) caused to enter said first sequential cylindrical mirror analyzer (SS1) at hole (H1), exits said second sequential cylindrical mirror analyzer (SS2) through hole (H2') if said charged particle ($e^-$) has an energy within a user determined detection range of energies and approached said first sequential cylindrical mirror analyzer (SS1) at an angle within a range of acceptance angles so as to pass through said hole (H1) through the tubular wall at said first end (E1) of said central-most essentially tubular shaped element (CCM) of said first sequential cylindrical mirror analyzer (SS1). Said energy detection range is at least partially determined by said electrical potential applied to each of said concentric outer (CO) and central-most (CCM) essentially tubular shaped elements in each said first and second sequential cylindrical mirror analyzers (SS1) (SS2).

It is emphasized that the present invention provides that the concentric outer (CO) (CO') or central-most essentially tubular shaped elements (CCM) (CMM') can each be, or each not be, or one thereof be and others thereof not be, made electrically, continuous with the outer Mu-Metal shield cylindrical housing (Mu). This applies equally to embodiments shown in FIGS. 3 and 4.

Figure 3:
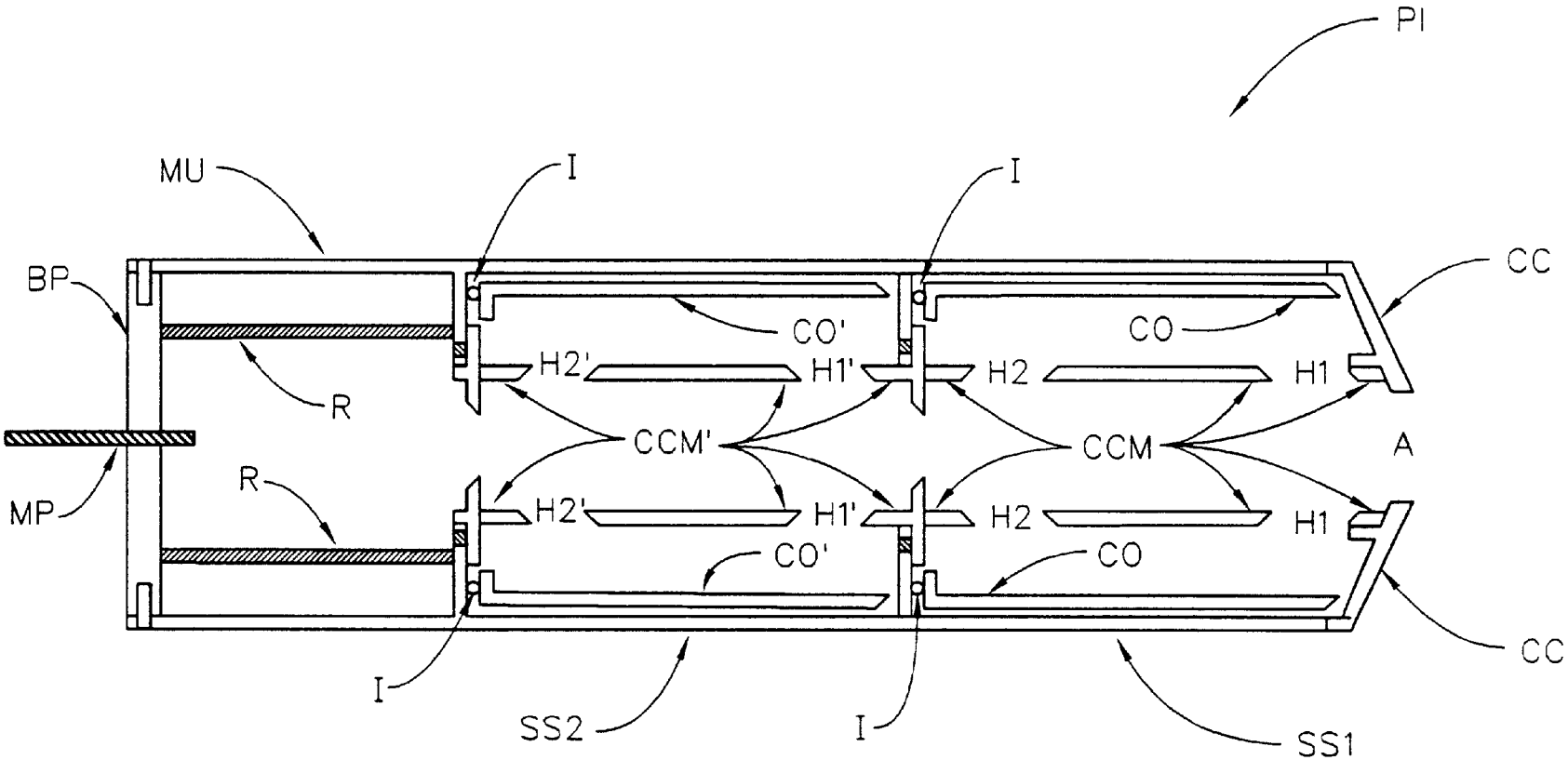
FIG. 3 shows a cut-away view of internal components of a preferred present invention compact, small diameter, high charged particle-energy detection resolution, multiple sequential stage, retractable cylindrical mirror analyzer system comprising two stages.

FIG. 3 shows the a side elevational cut-away view of the internal construction of a preferred two stage (SS1) (SS2), present invention compact, small diameter, high charged particle energy detection resolution, multiple sequential stage, retractable cylindrical mirror analyzer system (PI). Shown are the outer Mu-Metal shield cylindrical housing (Mu), an Aperture (A), a cap (CC), a first stage (SS1) concentric outer essentially tubular shaped element (CO), a concentric central-most essentially tubular shaped element (CCM) with holes (H1) and (H2) through said tubular wall thereof and the second stage (SS2) concentric outer essentially tubular shaped element (CO'), a concentric central-most essentially tubular shaped element (CCM') with holes (H1') and (H2') through said tubular wall thereof. It is to be noted that the concentric outer essentially tubular shaped elements (CO) (CO') are affixed to a projection from the outer Mu-Metal shield cylindrical housing (Mu) via insulating (I) means, (e.g. saphire offsets). Also shown are typically threaded interconnecting rods (R), backplate (BP) and position manipulator (MP). It is to be understood that the cap (CC) and backplate (BP) can be continuous with the outer Mu-Metal shield cylindrical housing (Mu), or separate elements which are affixed thereto via securing means. It is particularly emphasized that concentric outer essentially tubular shaped elements (CO) (CO') are shown in FIG. 3 as being not electrically continuous with one another, (each being secured to the outer Mu-Metal shield cylindrical housing (Mu) via insulating (I) means), such that a separate electric field can be effected between (CO) and (CMM) as compared to an electric field effected between (CO') and (CMM'). Also, concentric central-most essentially tubular shaped elements (CCM) and (CCM') can be or not, electrically continuous with one another. FIG. 2 demonstrates the case where there is no electrical continuity between any of the essentially tubular shaped elements (CO), (CO'), (CCM) and (CCM'). The ability to separately effect different or similar electric fields in different stages of the multiple present invention stages, and the ability to set any of the separate tubular shaped elements (CO), (CO'), (CCM) and (CCM') elements to ground potential, or above or below ground potential in use, is a distinguishing utility providing feature of the present invention.

Figure 4:
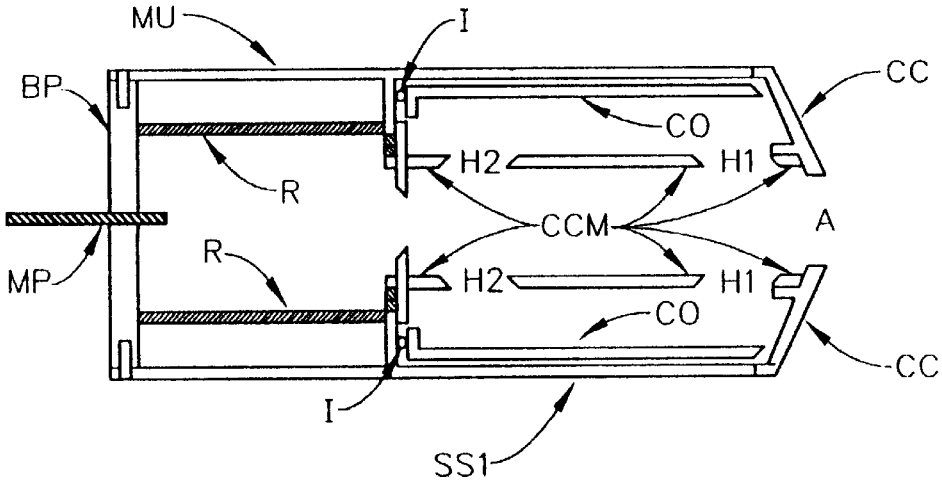
FIG. 4 shows a cut-away view of internal components of a present invention compact, small diameter, high charged particle-energy detection resolution retractable cylindrical mirror analyzer system comprising one stage.

FIG. 4 shows the a side elevational cut-away view of a one stage (SS1) present invention compact, small diameter, high charged particle-energy detection resolution, multiple sequential stage, retractable cylindrical mirror analyzer system (PI). The identifiers therein (MU), (BP), (MP), (R), (SS1), (A), (CO), (CCM), (H1), (H2) are the same as described with respect to FIG. 3 and are not repeated here. The distinction over the system shown in FIG. 3 is that only one stage (SS1) is present.

It is noted that the holes, (i.e. annular space "access past" (CCH) or (CCH') means), (H1), (H2), (H1') and (H2') in FIG. 3, (and FIG. 4), are shown as positioned offset from the ends of (CCM) and (CCM'). FIG. 2 indicates this is not required.

An important feature of the present invention compact, small diameter, high charged particle-energy detection resolution, multiple sequential stage, retractable cylindrical mirror analyzer system is that the second end of the last sequential stage ((SS2) in FIG. 3), of said multiple sequential stages further comprises a manipulator (MP) for manipulation of the compact, small diameter, high energy detection resolution, multiple sequential stage, retractable cylindrical mirror analyzer system (PI) into a position wherein charged particles can enter to said first sequential stage thereof. Said manipulator (MP) is typically, but not necessarily, affixed to a baseplate (BP) which in turn is affixed or continuous with the outer Mu-Metal shield cylindrical housing (Mu). Importantly, said manipulator (MP) can be affixed to or part of a bellows driven linear motion feedthrough, (see FIG. 1*b* for functional demonstration thereof).

It is noted that the outer (CO) (CO') essentially tubular shaped concentric element(s) typically have inner diameters of between 30 and 50 millimeters inclusive, and outer essentially tubular shaped concentric element(s) typically, but not necessarily, have the same inner diameter. As well, present central-most (CCM) (CCM') essentially tubular shaped concentric element(s) typically have outer diameters of between 15 and 40 millimeters inclusive, and all present center-most essentially tubular shaped concentric element(s) typically, but not necessarily, have the same outer diameter. Actual operating present invention systems to date have been constructed with a per stage (SS1) (SS2) length on the order of 4.5 centimeters, and with an overall outer diameter of approximately 2.25 centimeters. It is further noted that each stage of a present invention compact, small diameter, small diameter, high charged particle energy detection resolution, multiple sequential stage, retractable cylindrical mirror analyzer system typically has a focal length of from 5 to 10 millimeters, with a nominal value of 6 millimeters, in front of the first central-most cylinder entrance aperture.

As alluded to, the present invention compact, small diameter, high charged particle-energy detection resolution, multiple sequential stage, retractable cylindrical mirror analyzer system manipulator at the second end of the last sequential stage of said multiple sequential stages is a linear motion feedthrough, is optionally affixed to, and driven by, a bellows-type motion source, (see FIG. 1*b,* for instance). It has been found that all elements of the present invention so constructed can be easily mounted on a vacuum flange having a diameter less than 203 millimeters, and that the vacuum flange can be of a conflat type.

Figure 5:
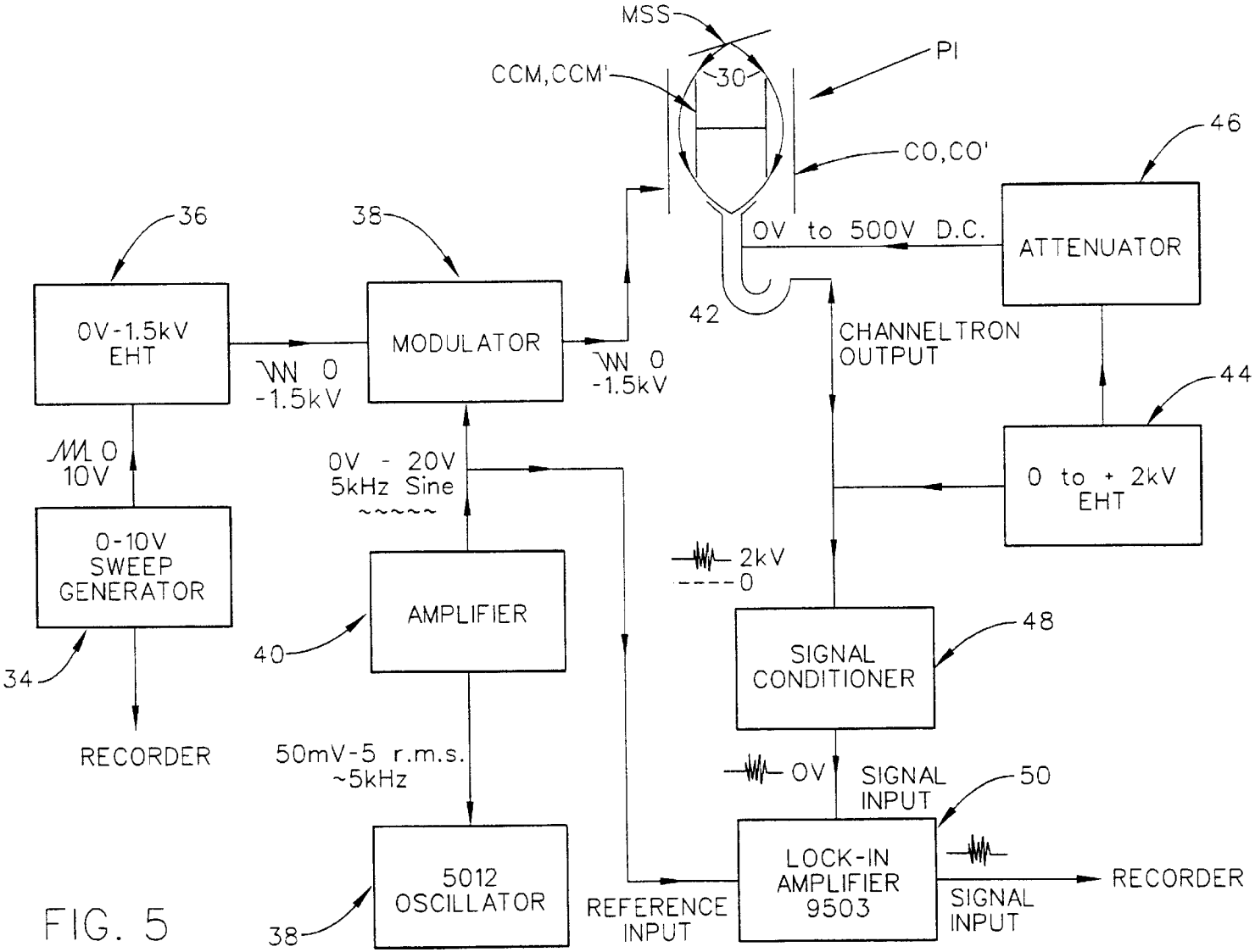
FIG. 5 shows a preferred electrical bias control and detector scheme circuitry for use with the present invention.

Turning now to FIG. 5, there is shown a preferred electrical bias control and detector scheme for the present invention. While not a part of the present invention per se., shown are a source of charged particles (MSS) and a present invention compact, small diameter, high charged particle-energy detection resolution, compact, small diameter, multiple sequential stage, retractable cylindrical mirror analyzer system (PI) which is oriented to receive said charged particles, which can be electrons or positive ions. (Note, to reduce drawing clutter, only components of a single stage (PI) are shown and it should be assumed, where appropriate that multiple stages of said components are present in (PI)). Continuing, the central-most (CCM) (CMM') essentially tubular shaped elements are typically held at ground potential and the concentric outer (CO) (CO') essentially tubular shaped elements are swept through a voltage range. For instance, a sweep generator (34) is shown to develop a sawtooth voltage of between 0.0 and 10 volts and provides a reference output to a recorder (not shown). The sawtooth output voltage drives −1.5 KV EHT (extremely high tension), generator (36) which produces a sawtooth output ramped from 0.0 to −1.5 KV, which is then fed into the signal modulator (38). Said signal modulator (38) modulates the output signal of EHT generator with a 20 volt sin-wave signal of approximately 5 KZ frequency. The sin-wave is generated by oscillator (38). The output of modulator (38) is fed to the concentric outer (CO) (CO') essentially tubular shaped elements, and to amplifier (40). The trajectory locus of charged particle stream (30) is effected thereby are discussed infra herein. A commercial channeltron (42) receives the charged particle stream (30) exiting (PI). Channeltron (42) receives a 0 to 500 Volt D.C. signal generated by a 2 KV EHT generator (44) having an output signal attenuated by attenuator (46). EHT generator (44) also has an output connected to the output of the Channeltron (42) which provides a varying output signal with a 2 KV D.C. signal superimposed thereupon. The output of Channeltron (42) is passed through a signal conditioner (48) which removes the D.C. component therefrom. The output signal is received by lock-in amplifier (50) which also receives a reference input signal from amplifier (40). The output signal of the lock-in amplifier (50) is sent to the recorder (not shown) for analysis of the experimental results.

Figure 6:
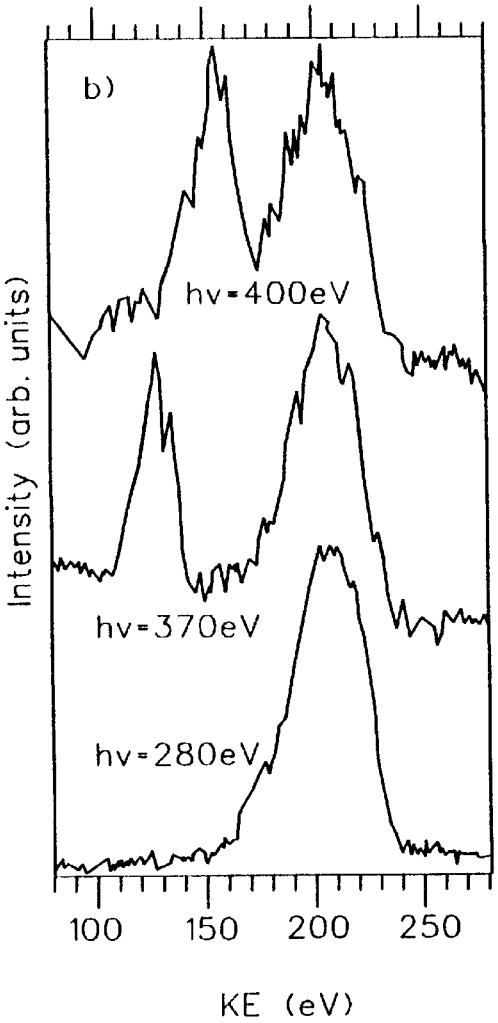
FIGS. 6 and 7 show LMM Auger spectra at various energies obtained utilizing a one stage and two stage present invention compact, small diameter, high charged particle-energy detection resolution retractable cylindrical mirror analyzer system, respectively, and demonstrate the improved resolution possible with multiple stage present invention systems.
Figure 7:
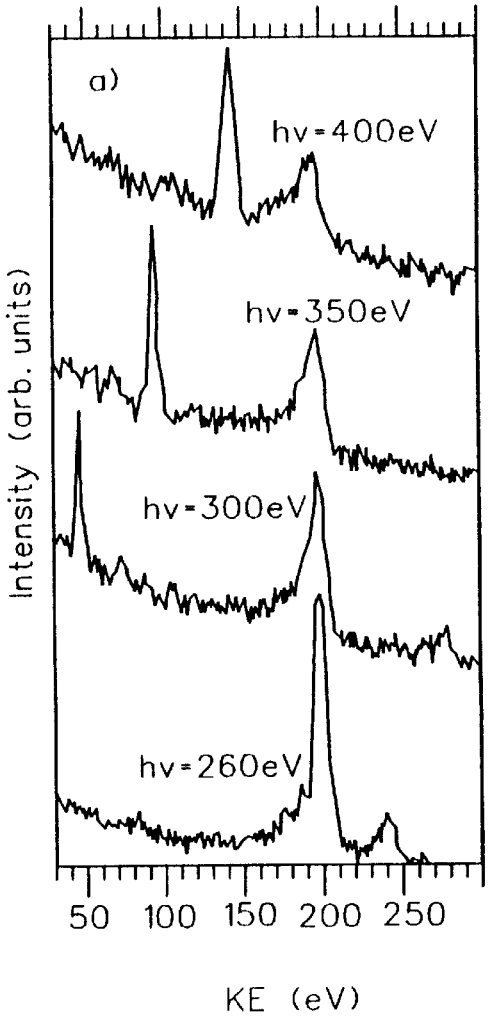

FIG. 6 shows Ar LMM-Auger Spectra particle analysis results obtained utilizing a single stage, (as shown in FIG. 4), version of the present invention, while FIG. 7 shows that improved resolution is achieved where a two stage, (as shown in FIGS. 2 and 3), version of the present invention small diameter cylindrical mirror analyzer is employed. Both plots show results obtained at three energy levels. The feature centered at the energy of approximately 210 eV in the three spectra corresponds to Argon Auger electrons, while the features at 120 eV and 150 eV in the spectra were obtained at photon energies of 370 eV and 400 eV respectively, and originate from Argon 2p core electron excitations. Again, the important thing to note is that the FIG. 7 results demonstrate improved resolution as evident by the reduced peak (LMM) width.

As discussion, in the 410 Patent previously pointed out, limitations in resolution of an AUGER spectrum are inherent to a small diameter cylindrical mirror analyzer, where signals obtained from atomic beam experiments are from a sampling volume which is at an intersection between atomic and photon beams. The reason is that the focal point of such an investigated volume is not well defined, as it is where surface region effects are investigated. This results in a broadening of spectral features which has an adverse effect the instrumental resolution of the analyzer. Where, however, the analyzer is operated in a constant energy mode, the LMM Auger electron yield measurements achieve much greater instrumental resolution. It was concluded in the 410 Patent, regarding the single pass (stage) small diameter cylindrical mirror analyzer disclosed therein, that said single pass (stage) small diameter cylindrical mirror analyzer provided simultaneous reduced size and sufficient instrument resolution, and this combination resulted in a versatile charged particle analyzer suitable for mounting on a linear motion feedthrough, (which further enhanced versatility). The same conclusions are applicable to the present invention double pass two stage small diameter cylindrical mirror analyzer. The present invention double pass two stage small diameter cylindrical mirror analyzer, however, also provides capability of greatly improved resolution capability over the system disclosed in the 410 Patent.

Methods of use of the present invention were described in the Disclosure of the Invention Section of this Disclosure and will not be repeated here.

Having hereby disclosed the subject matter of the present invention, it should be obvious that many modifications, substitutions, and variations of the present invention are possible in light of the teachings. It is therefore to be understood that the invention can be practiced other than as specifically described, and should be limited in breadth only by the claims.

We claim:

1. A compact, high resolution charged particle-energy detecting, multiple sequential stage, retractable cylindrical mirror analyzer system which enables charged particle-energy detection with an improved resolution compared to that possible where only a single stage cylindrical mirror analyzer is present, wherein each of said multiple sequential stages is a cylindrical mirror analyzer comprising:

a. a concentric outer essentially tubular shaped element having a tubular wall with an inner surface, and first and second ends;

b. a concentric central-most essentially tubular shaped element having a tubular wall with an outer surface and first and second ends, with openings which provide access past said tubular wall being present near both said first and second ends thereof, said central-most essentially tubular shaped element being present within said concentric outer essentially tubular shaped element such that an annular space is formed between the inner surface of the tubular wall of said outer essentially tubular shaped element and the outer surface of the tubular wall of said central-most essentially tubular shaped element;

c. means for applying electrical potential to each of said concentric outer and central-most essentially tubular shaped elements such that an electric field can be caused to exist in said annular space between said concentric outer and central-most essentially tubular shaped elements;

a second end of a first sequential cylindrical mirror analyzer being secured to a first end of a second sequential cylindrical mirror analyzer;

said concentric central-most essentially tubular shaped element of said first sequential cylindrical mirror analyzer being electrically separate from said concentric central-most essentially tubular shaped element of said second sequential cylindrical mirror analyzer;

such that a charged particle caused to enter said annular space between said concentric outer and central-most essentially tubular shaped elements at a first end of said central-most essentially tubular shaped element of said first sequential cylindrical mirror analyzer, has its trajectory locus determined by an electric field caused to be present therein by application of a first voltage between said concentric outer and central-most essentially tubular shaped elements, and can exit from said first sequential cylindrical mirror analyzer annular space at the second end of said center-most essentially tubular shaped element in said first sequential cylindrical mirror analyzer;

said charged particle then being caused to enter an annular space between said concentric outer and central-most essentially tubular shaped elements at a first end of said central-most essentially tubular shaped element of said second sequential cylindrical mirror analyzer, wherein its trajectory locus is determined by an electric field caused to be present therein by application of a second voltage between said concentric outer and central-most essentially tubular shaped elements, and can exit from said second sequential cylindrical mirror analyzer annular space at the second end of said second sequential cylindrical mirror analyzer;

said charged particle exiting from said second sequential cylindrical mirror analyzer annular space at the second end of said second sequential cylindrical mirror analyzer only if said charged particle has an energy within a detection range of acceptance energies, and approached said first sequential cylindrical mirror analyzer at an angle within a range of acceptance angles so as to pass through said opening which provides access past the tubular wall at said first end of said central-most essentially tubular shaped element of said first sequential cylindrical mirror analyzer, said energy detection range being at least partially determined by said electrical potential applied to each of said concentric outer and central-most essentially tubular shaped elements in each said first and second sequential cylindrical mirror analyzers.

2. A compact, high resolution charged particle-energy detecting, multiple sequential stage, retractable cylindrical mirror analyzer system as in claim 1, which further comprises at least a third stage sequential cylindrical mirror analyzer, wherein said third sequential cylindrical mirror analyzer stage comprises:

a. a concentric outer essentially tubular shaped element having a tubular wall with an inner surface, and first and second ends;

b. a concentric central-most essentially tubular shaped element having a tubular wall having an outer surface and first and second ends, with openings which provide access past said tubular wall being present near both said first and second ends thereof, said central-most essentially tubular shaped element being present within said concentric outer essentially tubular shaped element such that an annular space is formed between the inner surface of the tubular wall of said outer essentially tubular shaped element and the outer surface of the tubular wall of said central-most essentially tubular shaped element;

c. means for applying electrical potential to each of said concentric outer and central-most essentially tubular shaped elements such that an electric field can be caused to exist in said annular space between said concentric outer and central-most essentially tubular shaped elements;

the second end of said second sequential cylindrical mirror analyzer being secured to a first end of said third sequential cylindrical mirror analyzer.

3. A compact, high resolution charged particle-energy detecting, multiple sequential stage, retractable cylindrical mirror analyzer system as in claim 1, which further comprises sources of at least first and second voltages, said first voltage being that applied between said concentric outer and central-most essentially tubular shaped elements of said first sequential cylindrical mirror analyzer and being selected from the group consisting of:

the same as, and different than, relative to said second voltage which is that applied between said concentric outer and central-most essentially tubular shaped elements of said second sequential cylindrical mirror analyzer, such that the electric field in the annular space of said first sequential cylindrical mirror analyzer is caused to be a selection from the group consisting of:

the same as, greater than, and less than, as compared to the electric field in the annular space of the second sequential cylindrical mirror analyzer.

4. A compact, high resolution charged particle-energy detecting, multiple sequential stage, retractable cylindrical mirror analyzer system as in claim 1, in which the outer essentially tubular shaped concentric elements in said first sequential and second sequential cylindrical mirror analyzers each have a potential applied thereto separately selected from the group consisting of:

ground potential, a potential above ground, and a potential below ground, said potential being different than a potential applied to the corresponding center-most essentially tubular shaped concentric element in each of said first and second sequential cylindrical mirror analyzers respectively, such that an electric field is formed in the annular space in each of the first and second sequential cylindrical mirror analyzers.

5. A compact, high resolution charged particle-energy detecting, multiple sequential stage, retractable cylindrical mirror analyzer system as in claim 1, in which each stage of said multiple stages further comprises a cylindrical housing having first and second ends, a cylindrical housing corresponding to a stage being concentrically positioned outside and around said outer essentially tubular shaped concentric element.

6. A compact, high resolution charged particle-energy detecting, multiple sequential stage, retractable cylindrical mirror analyzer system as in claim 5, in which the cylindrical housing of the first sequential stage of said multiple sequential stages further comprises, at a first end thereof, a cap which presents with an aperture essentially centrally located therein.

7. A compact, high resolution charged particle-energy detecting, multiple sequential stage, retractable cylindrical mirror analyzer system as in claim 6, in which the second end of a last sequential stage of said multiple sequential stages further comprises a manipulator for manipulation of the compact, small diameter, high energy detection resolution, multiple sequential stage, retractable cylindrical mirror analyzer system into a position wherein charged particles can enter to said first sequential stage thereof.

8. A compact, high resolution charged particle-energy detecting, multiple sequential stage, retractable cylindrical mirror analyzer system as in claim 7 in which manipulator at the second end of the last sequential stage of said multiple sequential stages is affixed to a linear motion feedthrough, and is optionally affixed to, and driven by, a bellows-type motion source.

9. A compact, high resolution charged particle-energy detecting, multiple sequential stage, retractable cylindrical mirror analyzer system as in claim 8 which further comprises a vacuum flange having a diameter in the range of seventy to two-hundred and more millimeters, inclusive.

10. A compact, high resolution charged particle-energy detecting, multiple sequential stage, retractable cylindrical mirror analyzer system as in claim 9 wherein the vacuum flange is of a conflat type.

11. A compact, high resolution charged particle-energy detecting, multiple sequential stage, retractable cylindrical mirror analyzer system as in claim 6, in which at least one selection from the group consisting of:

each present cylindrical housing, and said cap, is made of magnetic field blocking mu-metal.

12. A compact, high resolution charged particle-energy detecting, multiple sequential stage, retractable cylindrical mirror analyzer system as in claim 1 in which the second end of a last sequential stage of said multiple sequential stages further comprises a manipulator for manipulation of the compact, small diameter, high energy detection resolution, multiple sequential stage, retractable cylindrical mirror analyzer system into a position wherein charged particles can enter to said first sequential stage thereof, said manipulator optionally being affixed to a bellows driven linear motion feedthrough.

13. A compact, high resolution charged particle-energy detecting, multiple sequential stage, retractable cylindrical mirror analyzer system as in claim 1, wherein all present outer essentially tubular shaped concentric element(s) have inner diameters of between 30 and 50 millimeters inclusive.

14. A compact, high resolution charged particle-energy detecting, multiple sequential stage, retractable cylindrical mirror analyzer system as in claim 1 in which all present outer essentially tubular shaped concentric elements have the same inner diameter.

15. A compact, high resolution charged particle-energy detecting, multiple sequential stage, retractable cylindrical mirror analyzer system as in claim 1, wherein all present central-most essentially tubular shaped concentric elements have outer diameters of between 15 and 40 millimeters inclusive.

16. A compact, high resolution charged particle-energy detecting, multiple sequential stage, retractable cylindrical mirror analyzer system as in claim 1 in which all present center-most essentially tubular shaped concentric elements have the same outer diameter.

17. A compact, high resolution charged particle-energy detecting, multiple sequential stage, retractable cylindrical mirror analyzer system as in claim 1, wherein at least one stage of said multiple stages has a focal length of from 5 to 10 millimeters, with a nominal value of 6 millimeters, in front of the first central-most cylinder.

18. A retractable cylindrical mirror analyzer system which enables charged particle-energy detection comprising:

a. a concentric outer essentially tubular shaped element having a tubular wall with an inner surface, and first and second ends;

b. a concentric central-most essentially tubular shaped element having a tubular wall with an outer surface and first and second ends, with openings which provide access past said tubular wall being present near both said first and second ends thereof, said central-most essentially tubular shaped element being present within said concentric outer essentially tubular shaped element such that an annular space is formed between the inner surface of the tubular wall of said outer essentially tubular shaped element and the outer surface of the tubular wall of said central-most essentially tubular shaped element;

c. means for applying electrical potential selected from the group consisting of:

ground, positive, and negative, to said concentric outer essentially tubular shaped element, and means for applying electrical potential separately selected from the group consisting of:

ground, positive, and negative, to said central-most essentially tubular shaped element such that an electric field can be caused to exist in said annular space between said concentric outer and central-most essentially tubular shaped elements;

such that a charged particle caused to enter said annular space between said concentric outer and central-most essentially tubular shaped elements at a first end of said central-most essentially tubular shaped element of said cylindrical mirror analyzer, has its trajectory locus determined by an electric field caused to be present therein by application of a voltage between said concentric outer and central-most essentially tubular shaped elements, and can exit from said cylindrical mirror analyzer annular space at the second end of said center-most essentially tubular shaped element in said retractable cylindrical mirror analyzer only if said charged particle has an energy within a detection range of acceptance energies, and approached said retractable cylindrical mirror analyzer at an angle within a range of acceptance angles so as to pass through said opening which provides access past the tubular wall at said first end of said central-most essentially tubular shaped element of said retractable cylindrical mirror analyzer, said energy detection range being at least partially determined by said electrical potential applied to each of said concentric outer and central-most essentially tubular shaped elements in said retractable cylindrical mirror analyzer;

said retractable cylindrical mirror analyzer further comprising a manipulator at said second end of said retractable cylindrical mirror analyzer for use in manipulation of the retractable cylindrical mirror analyzer system into a position wherein charged particles can enter to said first end thereof.

19. A retractable cylindrical mirror analyzer system as in claim 18 which further comprises a cylindrical housing having first and second ends, said cylindrical housing being concentrically positioned outside and around said outer essentially tubular shaped concentric element.

20. A retractable cylindrical mirror analyzer system as in claim 19, in which the cylindrical housing further comprises, at a first end thereof, a cap which presents with an aperture essentially centrally located therein.

21. A retractable cylindrical mirror analyzer system as in claim 20 in which the cap and cylindrical housing are selected from the group consisting of:

single piece continuous, and interconnected separate elements.

22. A retractable cylindrical mirror analyzer system as in claim 20, in which at least one selection from the group consisting of:

each present cylindrical housing, and said cap, is made of magnetic field blocking mu-metal.

23. A retractable cylindrical mirror analyzer system as in claim 19, in which the manipulator present at the second end of thereof is affixed to said cylindrical housing.

24. A retractable cylindrical mirror analyzer system as in claim 18, wherein the outer essentially tubular shaped concentric element has an inner diameter of between 30 and 50 millimeters.

25. A retractable cylindrical mirror analyzer system as in claim 18, wherein the central-most essentially tubular shaped concentric element has an outer diameter of between 15 and 40 millimeters inclusive.

26. A retractable cylindrical mirror analyzer system as in claim 18 wherein the outer essentially tubular shaped concentric element has an inner diameter of between 30 and 50 millimeters and wherein the central-most essentially tubular shaped concentric element has an outer diameter of between 15 and 40 millimeters inclusive.

27. A retractable cylindrical mirror analyzer system as in claim 18 in which manipulator at the second end thereof is a linear motion feedthrough.

28. A retractable cylindrical mirror analyzer system as in claim 18 in which manipulator at the second end thereof is a linear motion feedthrough and is affixed to a motion providing bellows.

29. A retractable cylindrical mirror analyzer system as in claim 18 which is mounted on a vacuum flange having a diameter in the range of seventy to two-hundred and more millimeters, inclusive.

30. A retractable cylindrical mirror analyzer system as in claim 29 wherein the vacuum flange is of a conflat type.

31. A retractable cylindrical mirror analyzer system as in claim 18, wherein the focal length of from 5 to 10 millimeters with a nominal value of 6 millimeters, in front of the first central-most cylinder.

32. A method of detecting charged particles of specific energies comprising the steps of:

a. providing a compact, high resolution charged particle-energy detecting, multiple sequential stage, retractable cylindrical mirror analyzer system which enables charged particle-energy detection with an improved resolution compared to resolution provided by a single stage cylindrical mirror analyzer, wherein each of said multiple sequential stages is a cylindrical mirror analyzer comprising:

1. a concentric outer essentially tubular shaped element having a tubular wall with an inner surface, and first and second ends;
2. a concentric central-most essentially tubular shaped element having a tubular wall with an outer surface and first and second ends, with openings which provide access past said tubular wall being present near both said first and second ends thereof, said central-most essentially tubular shaped element being present within said concentric outer essentially tubular shaped element such that an annular space is formed between the inner surface of the tubular wall of said outer essentially tubular shaped element and the outer surface of the tubular wall of said central-most essentially tubular shaped element;
3. means for applying electrical potential to said concentric outer and central-most essentially tubular shaped elements such that an electric field can be caused to exist in said annular space between said concentric outer and central-most essentially tubular shaped elements;

a second end of a first sequential cylindrical mirror analyzer being secured to a first end of a second sequential cylindrical mirror analyzer;

said concentric central-most essentially tubular shaped element of said first sequential cylindrical mirror analyzer being electrically separate from said concentric central-most essentially tubular shaped element of said second sequential cylindrical mirror analyzer;

such that a charged particle caused to enter said annular space between said concentric outer and central-most essentially tubular shaped elements at a first end of said central-most essentially tubular shaped element of said first sequential cylindrical mirror analyzer, has its trajectory locus determined by an electric field caused to be present therein by application of a first voltage between said concentric outer and central-most essentially tubular shaped elements, and can exit from said first sequential cylindrical mirror analyzer annular space at the second end of said center-most essentially tubular shaped element in said first sequential cylindrical mirror analyzer;

said charged particle then being caused to enter an annular space between said concentric outer and central-most essentially tubular shaped elements at a first end of said central-most essentially tubular shaped element of said second sequential cylindrical mirror analyzer, wherein its trajectory locus is determined by an electric field caused to be present therein by application of a second voltage between said concentric outer and central-most essentially tubular shaped elements, and can exit from said second sequential cylindrical mirror analyzer annular space at the second end of said second sequential cylindrical mirror analyzer;

said charged particle exiting from said second sequential cylindrical mirror analyzer annular space at the second end of said second sequential cylindrical mirror analyzer only if said charged particle has an energy within a detection range of acceptance energies, and approached said first sequential cylindrical mirror analyzer at an angle within a range of acceptance angles so as to pass through said opening which provides access past the tubular wall at said first end of said central-most essentially tubular shaped element of said first sequential cylindrical mirror analyzer, said energy detection range being at least partially determined by said electrical potential applied to each of said concentric outer and central-most essentially tubular shaped elements in each said first and second sequential cylindrical mirror analyzers;

a last sequential stare of said multiple sequential stages further comprising a manipulator for manipulation of the compact, small diameter, high energy detection resolution, multiple sequential stage, retractable cylindrical mirror analyzer system into a position wherein charred particles can enter to said first sequential stage thereof;

b. by manipulation of said manipulator, causing said first end of said first sequential stage cylindrical mirror analyzer to be positioned near charged particles;

c. causing electric fields to exist in the annular space of each present cylindrical mirror analyzer stage;

such that charged particles of desired specific energies enter said first stage cylindrical mirror analyzer of the compact, high energy detection resolution, multiple sequential stage, retractable cylindrical mirror analyzer system, progress through all stages thereof and exit the last stage thereof, and enter a detector.

33. A method of detecting charged particles of specific energies as in claim 32 in which the step of causing electric fields to exist in said annular space of each present cylindrical mirror analyzer stage involves causing different magnitude electric fields to exist in different stages of the compact, high energy detection resolution, multiple sequential stage, retractable cylindrical mirror analyzer system.

34. A method of detecting charged particles of specific energies as in claim 32 in which the step of causing electric fields to exist in said annular space of each present cylindrical mirror analyzer stage involves causing the same magnitude electric field to exist in at least two different stages of the compact, high energy detection resolution, multiple sequential stage, retractable cylindrical mirror analyzer system.

35. A method of detecting charged particles of specific energies as in claim 32 in which the step of manipulation of said manipulator, to cause said first end of said first sequential stage cylindrical mirror analyzer to be positioned near charged particles, involves imparting motion to said manipulator by a linear motion feedthrough which is optionally driven by a bellows-type motion source.

36. A method of detecting charged particles of specific energies comprising the steps of:

a. providing a retractable cylindrical mirror analyzer system which enables charged particle-energy detection, comprising:

1. a concentric outer essentially tubular shaped element having a tubular wall with an inner surface, and first and second ends;
2. a concentric central-most essentially tubular shaped element having a tubular wall with an outer surface and first and second ends, with openings which provide access past said tubular wall being present near both said first and second ends thereof, said central-most essentially tubular shaped element being present within said concentric outer essentially tubular shaped element such that an annular space is formed between the inner surface of the tubular wall of said outer essentially tubular shaped element and the outer surface of the tubular wall of said central-most essentially tubular shaped element;
3. means for applying electrical potential to each of said concentric outer and central-most essentially tubular shaped elements such that an electric field can be caused to exist in said annular space between said concentric outer and central-most essentially tubular shaped elements;

such that a charged particle caused to enter said annular space between said concentric outer and central-most essentially tubular shaped elements at a first end of said central-most essentially tubular shaped element of said cylindrical mirror analyzer, has its trajectory locus determined by an electric field caused to be present therein by application of a voltage between said concentric outer and central-most essentially tubular shaped elements, and can exit from said cylindrical mirror analyzer annular space at the second end of said center-most essentially tubular shaped element in said retractable cylindrical mirror analyzer only if said charged particle has an energy within a detection range of acceptance energies, and approached said retractable cylindrical mirror analyzer at an angle within a range of acceptance angles so as to pass through said opening which provides access past the tubular wall at said first end of said central-most essentially tubular shaped element of said retractable cylindrical mirror analyzer, said energy detection range being at least partially determined by said electrical potential applied to each of said concentric outer and central-most essentially tubular shaped elements in said retractable cylindrical mirror analyzer;

said retractable cylindrical mirror analyzer further comprising a manipulator at said second end of said retractable cylindrical mirror analyzer for use in manipulation of the retractable cylindrical mirror analyzer system into a position wherein charged particles can enter to said first end thereof;

b. by manipulation of said manipulator, causing said first end of retractable cylindrical mirror analyzer to be positioned near charged particles;

c. causing an electric field to exist in said annular space;

such that charged particles of specific energies enter said retractable cylindrical mirror analyzer, progress therethrough and exit therefrom and enter a detector.

37. A method of detecting charged particles of specific energies as in claim 36 in which the step of manipulation of said manipulator, to cause said first end of said first sequential stage cylindrical mirror analyzer to be positioned near charged particles, involves imparting motion to said manipulator by a linear motion feedthrough which is optionally driven by a bellows-type motion source.

38. A retractable cylindrical mirror analyzer system for use in analyzing the energy spectra of charged particles emitted from a charged particle source comprising:

a. an essentially cylindrically shaped housing having first and second ends, said essentially cylindrically shaped housing having an essentially conically shaped end cap with an aperture essentially centrally located therein at the first end thereof;

b. an outer essentially cylindrically shaped element concentrically positioned in said essentially cylindrically shaped housing;

c. an inner essentially cylindrically shaped element concentrically contained within said outer essentially cylindrically shaped element and having an opening exposed through the essentially centrally located aperture in said essentially conically shaped endcap at said first end of said essentially cylindrically shaped housing, said opening being positioned for receiving charged particles via said essentially centrally located aperture, said inner essentially cylindrically shaped element further having an exit opening through which charged particles may pass near the second end of said essentially cylindrically shaped housing;

d. a manipulator at the second end of said essentially cylindrically shaped housing, for use in manipulating the retractable cylindrical mirror analyzer system into an analysis position; and e. means for applying electrical potential or ground to said inner essentially cylindrically shaped element.

* * * * *